United States Patent [19]

Giaimo et al.

[11] Patent Number: 4,488,499

[45] Date of Patent: Dec. 18, 1984

[54] REPLACEABLE HOOK POINT AND NEEDLE GUARD FOR SEWING MACHINE LOOP TAKER

[75] Inventors: Anthony Giaimo, Staten Island, N.Y.; Thaddeus J. Zylbert, Morris Plains, N.J.

[73] Assignee: The Singer Company, Stamford, Conn.

[21] Appl. No.: 326,885

[22] Filed: Dec. 2, 1981

[51] Int. Cl.[3] ..... D05B 57/08

[52] U.S. Cl. ..... 112/230; 112/227

[58] Field of Search ..... 112/181, 182, 183, 184, 112/228, 229, 230, 231, 227

[56] References Cited

U.S. PATENT DOCUMENTS

| | | | |
|---|---|---|---|
| 420,847 | 2/1890 | Wheeler | 112/228 |
| 1,415,268 | 5/1922 | Smith | 112/228 |
| 1,863,077 | 6/1932 | Waterman | 112/230 |
| 2,015,472 | 9/1935 | Goosman | 112/228 |
| 2,019,284 | 10/1935 | Wesson | 112/228 |
| 2,866,425 | 12/1958 | Palmbach | 112/184 X |
| 3,049,086 | 8/1962 | Johnson | 112/228 X |
| 3,139,050 | 6/1964 | Grabowski | 112/228 X |
| 4,213,410 | 7/1980 | Johnson | 112/228 |
| 4,278,038 | 7/1981 | Johnson | 112/228 |

FOREIGN PATENT DOCUMENTS

| | | | |
|---|---|---|---|
| 62209 | 5/1892 | Fed. Rep. of Germany | 112/228 |
| 51127419 | 4/1978 | Japan . | |
| 53-56544 | 5/1978 | Japan | 112/228 |

*Primary Examiner*—Wm. Carter Reynolds

*Attorney, Agent, or Firm*—Robert E. Smith; Edward L. Bell

[57] ABSTRACT

A sewing machine loop taker is disclosed having a replaceable adjustable hook beak and needle guard fabricated as a integral element in which the dimensional relationships established in fabrication are not influenced by the means for securing or the provisions for adjustment of the element relatively to the loop taker.

3 Claims, 4 Drawing Figures

REPLACEABLE HOOK POINT AND NEEDLE GUARD FOR SEWING MACHINE LOOP TAKER

DESCRIPTION

Background of the Invention

Field of the Invention: This invention relates to the field of sewing machine loop takers, and more particularly, to a novel loop taker construction with a replaceable adjustable insert formed integrally with both a hook point and a needle guard.

DESCRIPTION OF THE PRIOR ART

Loop takers which have been known heretofore with a replaceable integral hook point and needle guard arrangements have on the one hand involved such a degree of flexibility between the hook point and the needle guard that the shape and dimensional characteristics of the hook body materially influences the operational relationship between the hook point and the needle guard. On the other hand, such known arrangements have involved complex articulated construction requiring a multiplicity of parts.

SUMMARY OF THE INVENTION

It is an object of this invention to provide a sewing machine loop taker construction with a replaceable and adjustable hook point and needle guard formed as a single integral insert element which is adjustably secured to the loop taker body by a simple fastening means.

It is also an object of this invention to provide a sewing machine loop taker construction with a replaceable adjustable insert including a hook point and a needle guard which are arranged in a predetermined relationship which remains uninfluenced by the dimensional characteristics of the loop taker body.

DESCRIPTION OF THE INVENTION

In the accompanying drawings only a sewing machine loop taker is disclosed together with the replaceable adjustable hook point and needle guard insert thereof. For a complete disclosure of one manner in which a loop taker embodying the features of this invention may be supported, driven, and associated with other elements of a sewing machine to concatenate threads in the formation of stitches, reference is made to the U.S. Pat. No. 3,693,565, Sept. 26, 1972 of S. J. Ketterer.

Figure 1:
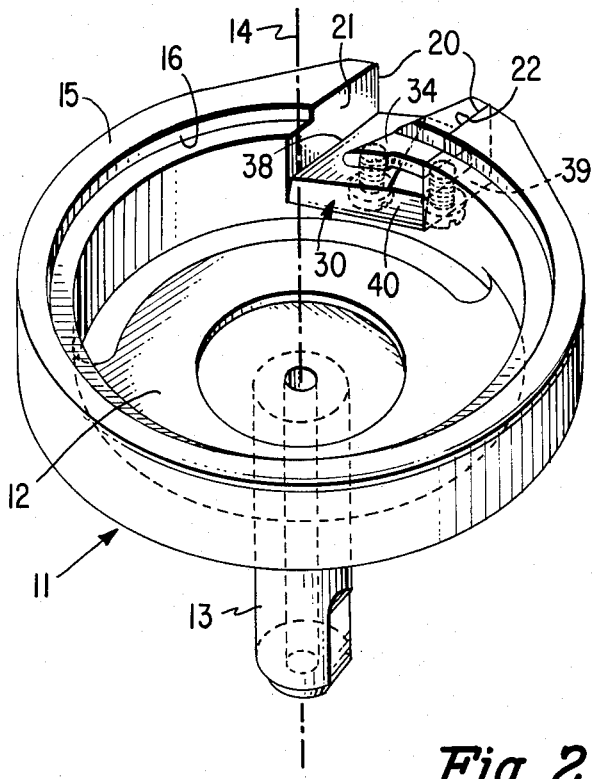
FIG. 1 is a perspective view of a sewing machine loop taker having a replaceable adjustable hook point and needle guard applied thereto in accordance with this invention.

As illustrated in FIG. 1, 11 indicates generally a rotary loop taker for a sewing machine that includes a body portion 12 to which is secured a shaft 13 defining an axis of rotation 14 for the loop taker when it is assembled into a sewing machine. The loop taker body portion 12 is formed with a circular rim 15 having a center of curvature substantially coincident with the axis of rotation 14. An inwardly facing bearing raceway 16 may be formed in the circular rim 15 to accommodate a bobbin case (not shown).

Figure 2:
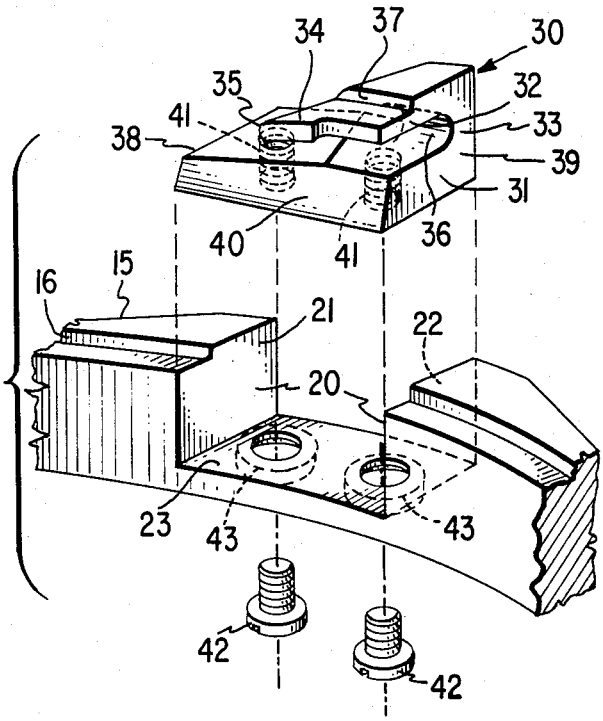
FIG. 2 is an enlarged disassembled perspective view of a fragment of the loop taker of FIG. 1, the replaceable adjustable hook point and needle guard, and the fastening means therefor.

As shown in FIG. 2, the circular rim 15 of the loop taker is not formed integrally with a hook beak or with a needle guard but instead is provided with a radial slot 20 in which to accommodate a replaceable and adjustable integral insert hook beak and needle guard portion indicated generally at 30. The slot 20 has parallel sidewalls 21 and 22 and a bottom surface 23 which occupies a plane perpendicular to the axis of rotation 14 of the loop taker. Preferrably the rim 15 of the loop taker adjacent to the slot 20 is radially enlarged to provide greater thickness to the sidewalls 21 and 22 of the slot 20.

Figure 3:
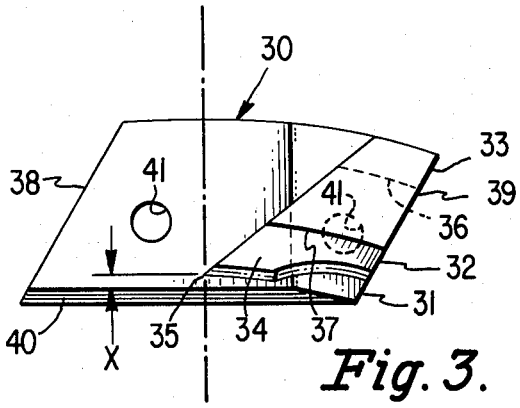
FIG. 3 is a top plan view of the integral hook point and needle guard element and FIG. 4 is an elevational view of the integral hook point and needle guard element including a fragment of the loop taker body and the fastening means.
Figure 4:
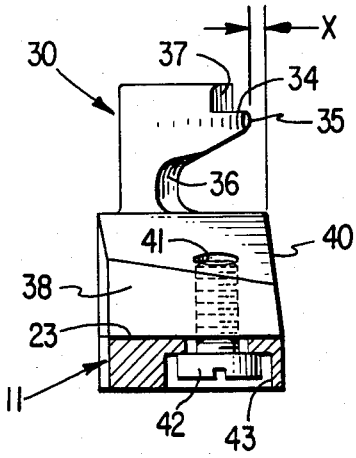

FIGS. 2, 3 and 4 illustrate the details of construction of the integral insert hook beak and needle guard portion 30. Preferrably the portion 30 is fabricated from generally "U"-shaped stock including as best shown in FIG. 2, a lower limb 31, an upper limb 32 and a base section 33 joining the limbs.

A hook beak 34 is formed on the upper limb 32 including a point 35 a throat 36 and a stepped shoulder 37 which in the assembled loop taker provides for a continuation of the bearing raceway 16. The hook beak 34 over hangs the lower limb 31 opposite extremities 38 and 39 of which are made parallel and spaced apart a distance equal to the width of the slot 20 so that the hook beak portion may be slidably arranged therein for radial adjustment. That side of the lower limb 31 beneath the hook point is formed with a needle guard surface 40 which as shown in FIGS. 3 and 4 is in its fabrication located a distance X radially inwardly of the hook point.

The lower limb 31 of the hook beak and needle guard portion is formed with one or more threaded holes 41 adapted to accommodate headed fastening screws 42 which pass through clearance holes 43 in the loop taker body portion 12 to secure the hook beak portion to the loop taker 11. The clearance holes provide for a limited range of radial adjustment of the hook beak portion relatively to the loop taker body portion.

The principal advantage of the construction of this invention is that it provides for a high degree of accuracy and stability in the critical spacing relationship between the hook point and the needle guarding surface of the assembled loop taker in a simple, economical, and dependable manner. Once established by the fabrication of the hook beak portion 30 this dimensional relationship is immutable and it is not altered or varied in the assembly of the portion 30 onto the loop taker body nor is it changed when the radial position of the portion 30 is adjusted on the loop taker.

Since the dimensions, shape and characteristics of the loop taker 11 do not influence the critical relationship between the hook beak and the needle guard, the loop taker body portion may be fabricated using materials and methods chosen for other attributes, not necessarily related to the highly critical accuracy of the hook beak to needle guard dimension and this also contributes significantly to the successful operating characteristics and cost effectiveness of the construction of this invention.

We claim:

1. A vertical axis sewing machine loop taker comprising a body portion including support means defining an axis of rotation therefor, a circular rim extending from said body portion and having a center of curvature substantially coincident with said axis of rotation, said circular rim being formed with a substantially radial slot with parallel sidewalls and a bottom surface which occupies a plane perpendicular to the axis of said loop taker, an integral insert portion having opposite extremities formed with parallel surfaces spaced apart a distance equal to the width of said radial rim slot so that said integral insert may be slidably arranged therein for radial adjustment, said insert portion being formed with a hook beak and with a needle guard rigidly disposed in predetermined relation to each other, and fastening means for securing said insert portion in a fixed position in said rim slot of said loop taker body portion with said needle guard extending radially inwardly of said hook beak.

2. A vertical axis sewing machine loop taker as set forth in claim 1 in which said integral insert portion comprises "U" shaped member having spaced limbs extending from a common base section, in which said hook beak is formed on one of said spaced limbs and in which said needle guard is formed on the other of said spaced limbs.

3. A vertical axis sewing machine loop taker as set forth in claim 2 in which that limb of said integral insert portion on which the needle guard is formed is arranged against the bottom suface of the loop taker rim slot when the insert portion is secured therein by said fastening means, and in which opposite extremities of the base section and said other limb of the "U" shaped insert portion are provided with the said parallel surfaces complimental to the parallel sidewalls of said loop taker rim slot.

* * * * *